United States Patent [19]

Nakamura et al.

[11] 4,172,726

[45] Oct. 30, 1979

[54] METHOD FOR FORMING PHOTOGRAPHIC IMAGES

[75] Inventors: Shigeru Nakamura; Isao Shimamura, both of Minami-ashigara, Japan

[73] Assignee: Fuji Photo Film Co., Ltd., Minami-ashigara, Japan

[21] Appl. No.: 825,512

[22] Filed: Aug. 17, 1977

[30] Foreign Application Priority Data

Aug. 24, 1976 [JP] Japan ..... 51/100970

[51] Int. Cl.[2] ..... G03C 7/00; G03C 5/32; G03C 5/30

[52] U.S. Cl. ..... 96/55; 96/22; 96/60 R; 96/66 R

[58] Field of Search ..... 96/60, 22, 66, 55

[56] References Cited

U.S. PATENT DOCUMENTS

| | | | |
|---|---|---|---|
| 3,767,401 | 10/1973 | Newman | 96/60 R |
| 3,923,511 | 12/1975 | Bissonette | 96/60 R |
| 3,928,040 | 12/1975 | Shimamura et al. | 96/60 R |

*Primary Examiner*—Mary F. Kelley

*Attorney, Agent, or Firm*—Sughrue, Rothwell, Mion, Zinn and Macpeak

[57] ABSTRACT

A method for forming images which comprises image-amplifying an image-wise exposed photographic element comprising a support having thereon at least one silver halide photographic layer containing an image-wise distributed material having a catalytic action by processing the photographic element with a solution containing (1) at least one cobalt (III) complex and (2) at least one organic phosphonic acid compound in the presence of a reducing agent.

7 Claims, No Drawings

METHOD FOR FORMING PHOTOGRAPHIC IMAGES

BACKGROUND OF THE INVENTION

1. Field of the Invention

The present invention relates to a method for forming photographic images by intensification or amplification, and more particularly, relates to an improvement in an image amplification method using a cobalt (III) complex, that is, relates to a method for increasing the stability of image amplification by using a processing solution containing a cobalt (III) complex and an organic phosphonic acid. 2. Description of the Prior Art In the field of color photographic methods, a color-forming agent such as a cyan coupler, a yellow coupler or a magenta coupler is incorporated into a silver halide emulsion by various methods, the silver halide emulsion is coated on a support to provide a color photographic element, and after image-wise exposure, the element is subjected to processing to reproduce images on the element.

The processing basically includes a color developing step and a desilvering step. That is, in the color developing step, silver halides of the exposed color photographic element are reduced by a color developing agent to form silver images, and the oxidized color developing agent is reacted with a color-forming agent to form dye images. Then, the color photographic element is subjected to a desilvering step. In this step, the silver images formed in the color developing step are oxidized with an oxidizing agent (which is usually called a bleaching agent) and dissolved with a silver ion-complexing agent which is called a fixing agent to remove the silver from the photographic element. As a result, only dye images remain in the photographic element. Practical developing processes are often accompanied by auxiliary steps for maintaining the photographic and physical quality of the images or for improving the storage stability of the images in addition to the above two basic steps (i.e., color development and desilvering). The auxiliary steps can include, for example, a hardening bath for preventing a light-sensitive layer from softening excessively in the processings, a stopping bath for effectively stopping the development, an image-stabilizing bath for stabilizing the images or a bath for removing a backing layer from the support. Color photographic light-sensitive elements employed in the color photography usually contain about 1 g to 15 g of silver per $m^2$ of the element in the form of a silver halide. For example, reflection type image-forming elements, of which color papers are representative, contain 1 to 2.5 g of silver per $m^2$ of the element, and photographic elements used in a camera, for example, color negative films or color reversal films, contain 3 to 9 g of silver per $m^2$ of the element. This amount of silver is necessary for obtaining sufficient color density of images, but if the amount of silver can be reduced, many advantages such as conservation of silver resources and costs are achieved.

U.S. Pat. No. 3,674,490 discloses a color amplifying method can be used to reduce the amount of silver in photographic elements. In this method, metal images distributed in an image-wise manner act as a catalyst, whereby a peroxide such as hydrogen peroxide is activated to carry out an oxidation reaction and as the result, a dye is produced and, therefore, color images are formed. A very small amount of metal is used in the method because the metal images act as a catalyst. Accordingly, where the metal for forming images is silver, sufficient color density can be provided by using a smaller amount of a silver salt than that used in conventional gelatino-silver halide emulsions. In the method, the peroxide is used in an amplifying step following a developing step, of which color development is representative. However, this method has many disadvantages. For example, the peroxide is unstable in an aqueous solution, and the peroxide causes a marked degree of fog in the amplification.

U.S. Pat. Nos. 3,826,652, 3,834,907, 3,748,138 and 3,765,891 disclose other color amplifying methods can be used to reduce the amount of silver halide in photographic elements. In these methods, metal images which are distributed in an image-wise manner and act as catalysts cause an oxidation-reduction reaction with a Co (III) complex such as $[Co(NH_3)_6]Cl_3$ to occur to form dyes, whereby color images are formed. However, serious disadvantages also arise in these methods as well. That is, an amplifying solution or developer-amplifying solution containing the Co (III) complex is unstable with the passage of time. In other words, the Co (III) complex and a reducing agent undergo an oxidation-reduction reaction in the amplifying solution or developer-amplifying solution to form ammonia or amines, which generate fog. Therefore, image amplifying methods using a Co (III) complex have serious disadvantages.

Some proposals have been made to improve the above-described disadvantages in these methods. One improvement is disclosed in U.S. patent applications Ser. No. 307,891, filed Nov. 20, 1972 and Ser. No. 307,892, filed Nov. 20, 1972, corresponding to Belgian Patent Nos. 807,567 and 807,568, respectively, and U.S. Pat. Nos. 3,847,619 and 3,904,413, in which the Co (III) complex is incorporated into a silver halide light-sensitive element. However, the method has the disadvantage that sensitivity of silver halide is markedly decreased as a result.

The description in *Research Disclosure* 13,527 (No. 135, pages 19–20, July, 1975) is that tetrazolium salts can be added to an amplifying solution to capture a reducing agent, particularly a developing agent, incorporated into the amplifying solution. Further, the description in *Research Disclosure* 10,911 (No. 109, pages 25–28, May, 1973) is that active carbonyl compounds can be added to an amplifying solution to remove ammonia produced in the method. However, these two methods provide insufficient stability with the passage of time. It is believed that the reaction of the Co (III) complex and the developing agent should be prevented or controlled to eliminate the problems.

A method has been proposed in which an image amplification is carried out by using the Co (III) complex while the amount of amplifying solution used for replenishment is markedly increased to control the concentration of ammonia. But according to this method, large amounts of Co (III) complex which is expensive must be used, and pollution problems arise due to the waste Co (III) complex and Co (II) complex. As another improvement, including a washing step between the color developing step and the amplifying step has been proposed so that a developing agent is not carried over into the amplifying solution. This method results, however, in a less effective image amplification.

Two processes are known for image amplification using a Co (III) complex, that is, (1) color development→amplification→desilvering, and (2) simultaneous color development-amplficiation→desilvering. In process (1), one step (i.e., the amplifying step) is added to the steps in conventional color developing processes and fog occurs, while the concentration of the developing agent in the amplifying solution is kept lower than in process (2). Process (2) is more advantageous than process (1) in some points, but a reaction of Co (III) complex and color developing agent easily occurs because the Co (III) complex and the color developing agent are present in a high concentration, and the thus-produced ammonia or amine makes the process impractical.

SUMMARY OF THE INVENTION

Therefore, an object of the invention is to provide a method for increasing the stability of an amplifying solution or a developer-amplifying solution containing a Co (III) complex.

Another object of the invention is to provide a method for increasing the stability of a developer-amplifying solution containing a Co (III) complex and a developing agent.

Still another object of the invention is to provide an improved image-amplifying method for controlling the reaction of a Co (III) complex and a developing agent.

The above objects of the invention are attained by an image-forming method which comprises image-amplifying an image-wise exposed photographic element comprising a support having thereon at least one silver halide photographic layer containing an image-wise distributed material having a catalytic action by processing the photographic element with a solution containing (1) at least one Co (III) complex and (2) at least one organic phosphonic acid in the presence of a reducing agent.

DETAILED DESCRIPTION OF THE INVENTION

The cobalt complex used in the present invention is an inert complex of trivalent cobalt (cobalti-complex) which exhibits a slow ligand exchange reaction velocity.

The term "inert complex" refers to complexes of a cobalt ion with a ligand which, when a test sample thereof is dissolved at 0.1 molar concentration at 20° C. in an inert solvent solution also containing 0.1 molar concentration of a tagged ligand of the same species which is uncoordinated, exhibits essentially no exchange of uncoordinated and coordinated ligands for at least 1 minute, and preferably for at least several hours, such as up to 5 hours or more. Reference can be made to: (1) *Chem. Rev.* Vol. 50, page 69 (1952), (2) Basolo and Pearson, *Mechanism of Inorganic Reactions, A Study of Metal Complexes and Solutions,* 2nd Ed. (1967).

A desired complex can be formed by combining various ligands with cobalt ion. Most Lewis bases (i.e., materials hving an unshared electron-pair) can be a ligand for the cobalti complex. Some typically useful ligands are disclosed in Basolo and Pearson, *Mechanisms of Inorganic Reactions, A Study of Metal Complexes and Solutions,* 2nd Edition, page 141, John Wiley and Sons Co., New York (1967), and in addition, include halides such as chloride, bromide or fluoride, nitrites, water and ammines.

The stability of the complexes depends on the properties of ligands selected for forming the complexes. More useful cobalti complexes have a coordination number of 6 and a ligand selected from the group consisting of ethylenediamine (en), diethylenetriamine (dien), triethylenetetramine (trien), ammine ($NH_3$), nitrate, nitrite, azide, chloride, thiocyanate, isothiocyanate, water, carbonate and ethylenediamine tetraacetic acid (EDTA). Preferred cobalti complexes contain (1) at least two ethylenediamine ligands, (2) at least five ammine ligands or (3) a triethylenetetramine ligand. A particularly useful complex is a cobalti-hexamine salt (e.g., chloride, bromide, sulfite, sulfate, perchlorate, nitrite or acetate). Other useful cobalti-complexes are represented by the following formulae:

$[Co(NH_3)_5H_2O]X$; $[Co(NH_3)_5CO_3]X$; $[Co(NH_3)_5Cl]X$; $[Co(NH_3)_4CO_3]X$; cis-$[Co(en)_2(N_3)_2]X$; trans-$]Co(en)_2Cl(NCS)]X$; trans-$[Co(en)_2(N_3)_2]X$; cis-$[Co(en)_2(NH_3)N_3]X$; cis-$[Co(en)_2Cl_2]X$; trans-$[Co(en)_2Cl_2]X$; $[Co(en)_2(SCN)_2]X$; and $[Co(en)_2(NCS)_2]X$ wherein X is one or more anions, e.g., as described above, and determined so as to render the complex electrically neutral.

Suitable organic phosphonic acids which can be employed in this invention are represented by the formulae (I) and (II):

$$R_1N(CH_2PO_3M_2)_2 \quad (I)$$

wherein M is a hydrogen atom or a cation providing water-solubility (e.g., an alkali metal ion such as sodium or potassium ion; an ammonium ion; a pyridinium ion; a triethanolammonium ion, triethylammonium ion, etc.), and $R_1$ is an alkyl group having 1 to 4 carbon atoms (e.g., methyl, ethyl, propyl, isopropyl, butyl, etc.), an aryl group (e.g., phenyl, o-tolyl, p-tolyl, p-carboxyphenyl, a water-soluble salt of p-carboxyphenyl such as the sodium or potassium salt, etc.), an aralkyl group (e.g., benzyl, β-phenethyl, o-acetamidobenzyl, etc., more particularly having 7 to 9 carbon atoms), an alicyclic group (e.g., a 5- or 6-membered alicyclic group such as cyclohexyl, cyclopentyl, etc.), or a heterocyclic group (e.g., a 5- or 6-membered heterocyclic group such as pyridyl) or a heterocyclic alkyl group (e.g., a 5- or 6-membered heterocyclic alkyl group having 1 to 4 carbon atoms in the alkyl moiety thereof such as pyrrolidylmethyl, pyrrolidylbutyl, benzothiazolylmethyl, tetrahydroquinolylmethyl, etc.), $R_1$ (particularly when $R_1$ is an alkyl group) may be substituted with one or more of a hydroxyl group, an alkoxy group (e.g., methoxy or ethoxy), a halogen atom (e.g., chlorine, bromine or iodine), $—PO_3M_2$, $—CH_2PO_3M_2$ or $—N(CH_2PO_3M_2)_2$ in which M has the same definition as described above;

$$R_2R_3C(PO_3M_2)_2 \quad (II)$$

wherein $R_2$ is a hydrogen atom or an alkyl group, an aralkyl group, an alicyclic group, a heterocyclic group or a heterocyclic alkyl group as described above for $R_1$, $—CHR_4—PO_3M_2$ (in which $R_4$ is a hydrogen atom, a hydroxyl group or an alkyl group) or $—PO_3M_2$, and $R_3$ is a hydrogen atom, a hydroxyl group, an alkyl group, a substituted alkyl group as described above for $R_1$ or $—PO_3M_2$ (in which M has the same definition as above).

Compounds represented by the formula (II) are more preferred in the invention.

Typical examples of phosphonic acids represented by the formula (I) and the formula (II) are shown below. However, the present invention is not to be construed as being limited to the specific compounds described below.

Compounds of the Formula (I)

(1) Ethylenediamine-N,N,N',N'-tetramethylene phosphonic acid
(2) Nitrilo-N,N,N-trimethylene phosphonic acid
(3) 1,2-Cyclohexanediamine-N,N,N',N'-tetramethylene phosphonic acid
(4) o-Carboxyaniline-N,N-dimethylene phosphonic acid
(5) Propylamine-N,N-dimethylene phosphonic acid
(6) 4-(N-pyrrolidino)butylamine-N,N-bis(methylene phosphonic acid)
(7) 1,3-Diaminopropanol-N,N,N',N'-tetramethylene phosphonic acid
(8) 1,3-Propanediamine-N,N,N',N'-tetramethylene phosphonic acid
(9) 1,6-Hexanediamine-N,N,N',N'-tetramethylene phosphonic acid
(10) o-Acetamidobenzylamine-N,N-dimethylene phosphonic acid
(11) o-Toluidine-N,N-dimethylene phosphonic acid
(12) 2-Pyridylamine-N,N-dimethylene phosphonic acid Compounds of the Formula (II)

(13) 1-Hydroxyethane-1,1-diphosphonic acid
(14) Ethane-1,1,1-triphosphonic acid
(15) 1-Hydroxy-2-phenylethane-1,1-diphosphonic acid
(16) 2-Hydroxyethane-1,1-diphosphonic acid
(17) 1-Hydroxyethane-1,1,2-triphosphonic acid
(18) 2-Hydroxyethane-1,1,2-triphosphonic acid
(19) Ethane-1,1-diphosphonic acid
(20) Ethane-1,2-diphosphonic acid The amount of the cobalt (III) complex which can be employed in the invention is about 0.1 g to about 100 g, preferably 0.2 g to 80 g, more preferably 0.4 g to 40 g, per liter of the processing solution. A suitable amount of the organic phosphonic acid which can be used in the invention is about 0.1 g to about 100 g, particularly 0.5 g to 50 g, more particularly 1 g to 20 g, per liter of the processing solution.

A processing solution containing the cobalt (III) complex and the organic phosphonic acid has a pH of about 7 to about 14, preferably pH of 8 to 11.

The processing solution containing the cobalt (III) complex may also contain any compounds generally employed in conventional developing solutions. For example, examples of such compounds include an alkali agent, a buffering agent, etc., such as sodium hydroxide, potassium hydroxide, sodium carbonate, potassium carbonate, trisodium phosphate, tripotassium phosphate, potassium metaborate, borax, etc., which may be employed individually or in combination. Further, for the purpose of providing a buffering action, of convenience in preparing the solution or of increasing the ionic strength of the solution, various salts such as disodium phosphate, dipotassium phosphate, sodium dihydrogen phosphate, potassium dihydrogen phosphate, sodium dicarbonate, potassium dicarbonate, boric acid, an alkali metal nitrate or an alkali metal sulfate can be employed.

If desired, any of the known development promotors can be added to the processing solution. Examples include pyridinium compounds, other cationic compounds, cationic dyes such as phenosafranine, neutral salts such as thallium nitrate or potassium nitrate as disclosed in U.S. Pat. Nos. 2,648,604 and 3,671,247, and Japanese Patent Publication No. 9503/69; polyethylene glycol and the derivatives thereof, nonionic compounds such as polythioethers as disclosed in Japanese Patent Publication No. 9504/69, U.S. Pat. Nos. 2,533,990, 2,531,832, 2,950,970 and 2,577,127; organic solvents as disclosed in Japanese Patent Publication No. 9509/69 and Belgian Patent No. 682,862; organic amines; ethanolamine, ethylenediamine and diethanolamine. Development promotors as disclosed in L. F. A. Mason, *Photographic Processing Chemistry,* pages 40 to 43, Focal Press, London (1966) can be employed in the invention. In addition, benzyl alcohol and phenylethyl alcohol as disclosed in U.S. Pat. No. 2,515,147, pyridine, ammonia, hydrazine and amines as disclosed in *Journal of the Japanese Photographic Society,* Vol. 14, page 74 (1952) are effective as development promotors.

Also, hydroxylamine sulfate or hydrochloride, sodium sulfite, potassium sulfite, sodium bisulfite and potassium bisulfite can be added.

Any known anti-foggants can be also added, if desired, to the processing solution. Examples of suitable anti-foggants which can be used include inorganic anti-foggants, e.g., alkali metal halides such as potassium bromide, sodium bromide or potassium iodide, and organic anti-foggants. Examples of organic anti-foggants include nitrogen-containing heterocyclic compounds such as benzotriazole, 6-nitrobenzimidazole, 5-nitroisoindazole, 5-methylbenzotriazole, 5-nitrobenzotriazole or 5-chlorobenzotriazole; mercapto-substituted heterocyclic compounds such as 1-phenyl-5-mercaptotetrazole, 2-mercaptobenzimidazole or 2-mercaptobenzothiazole; and mercapto-substituted aromatic compounds such as thiosalicylic acid. More preferred anti-foggants are nitrogen-containing heterocyclic compounds, particularly those which are not substituted with a mercapto group. A suitable amount of the anti-foggant is about 1 mg to about 5 g, preferably 5 mg to 1 g per liter of the amplifying solution.

Polyphosphoric acid compounds such as sodium hexametaphosphate, sodium tetrapolyphosphate, sodium tripolyphosphate, the potassium salts thereof, etc., and aminopolycarboxylic acids such as ethylenediaminetetraacetic acid, nitrilotriacetic acid, cyclohexanediaminetetraacetic acid, iminodiacetic acid, N-hydroxymethylethylenediaminetriacetic acid or diethylenetriaminepentaacetic acid can be used as a water-softening agent. The amount of the water-softening agent generally employed is usually about 0.5 to about 1 g/l, while it varies depending on the hardness of water to be used. A calcium- or magnesium-sequestering agent can be employed in the photographic solution of the invention. Specific examples which are suitable are disclosed in J. Willems, *Belgisches Chemiches Industry,* Vol. 21, page 325 (1956) and ibid., Vol. 23, page 1105 (1958).

Examples of reducing agents which can be used in the invention include a p-phenylenediamine color developing agent, an onium salt type p-aminophenol color developing agent as disclosed in U.S. Pat. No. 3,791,827, a dye developer as disclosed in U.S. Pat. No. 2,983,606, a diffusible dye releasing (DDR) redox compound as disclosed in Japanese Patent Application (OPI) No. 33,826/73, a developing agent capable of forming a dye when reacted with an amidrazone compound as disclosed in Japanese Patent Publication No. 39,165/73, a reducing agent capable of forming a dye or lake when oxidized (e.g., tetrazonium salts, 2,4-diaminophenol, α-nitroso-β-naphthol or leuco dyes), and a reducing agent capable of forming color images after oxidation as disclosed in Japanese Patent Application (OPI) No. 6,338/72 (pages 9–13). These reducing agents can be grouped into three types of reducing agents—one class which is a developing agent capable of forming a dye by coupling with a color forming agent after oxidation thereof, another class which is able to form a dye by the oxidation thereof, and a third class which is previously colored and releases a non-diffusible dye by oxidation.

The reducing agent used in the invention is employed with the cobalt (III) complex or in a developing solution for the photographic element prior to processing the photographic element with an amplifying solution containing the cobalt (III) complex.

The most preferred reducing agents which can be employed in the invention are p-phenylenediamine color developing agents. Typical examples of p-phenylenediamine color developing agents are N,N-diethyl-p-phenylenediamine hydrochloride, 4-amino-3-methyl-N,N-diethylaniline hydrochloride, 4-amino-3-methyl-N-ethyl-N-laurylaniline, 4-[N-ethyl-N-(β-hydroxyethyl)amino]aniline sulfate, 4-amino-3-methyl-N-ethyl-N-(β-hydroxyethyl)aniline sulfate, 4-amino-3-methyl-N-ethyl-N-(β-methanesulfoamidoethyl)aniline sesquisulfate monohydrate, as disclosed in U.S. Pat. No. 2,193,015, 4-amino-3-(β-methanesulfamidoethyl)-N,N-diethylaniline sulfate as disclosed in U.S. Pat. No. 2,592,364, N,N-dimethyl-p-phenylenediamine hydrochloride, 4-amino-3-methyl-N-ethyl-N-methoxyethylaniline as disclosed in U.S. Pat. Nos. 3,656,950 and 3,698,525, 4-amino-3-methyl-N-ethyl-N-β-ethoxyethylaniline, 4-amino-3-methyl-N-ethyl-N-β-butoxyethylaniline and the salts thereof (e.g., the sulfates, hydrochlorides, sulfites, p-toluenesulfonates, etc.). Other examples of suitable compounds are disclosed in *Kagaku Shashin Binran,* middle volume, page 72, Maruzen Co., Japan (1959), and L. F. A. Mason, *Photographic Processing Chemistry,* pages 226–229, Focal Press, London (1966). A suitable amount of reducing agent is about 0.1 to about 100, preferably 0.5 to 50 g/l, of developing solution or development amplifying solution.

Examples of the image-wise distributed materials which can be used as a catalyst are latent images, developing nuclei, or partially or completely reduced metallic silver. In some cases, the material may be an image-wise distributed noble metal element which is obtained by treating the latent images with an aqueous solution of a gold salt such as $HAuCl_3$ or a platinum salt such as $K_2PtCl_6$ as described in U.S. Pat. No. 3,390,998 and U.S. Defensive Publication T-869,012. If desired, the material may be silver images which are transferred from light-sensitive elements to receiving elements by silver salt diffusion transfer methods, or may be metal images which are obtained by treating latent images formed on photoconductive materials (e.g., titanium oxide or zinc oxide) with noble metal compounds such as silver salts such as $AgNO_3$ or gold salts such as $HAuCl_3$. Further, the material may be zero-valent metals or sulfides selected from metals of Group IB or VIII of the Periodic Table. Of these materials having a catalytic function, platinum, palladium, copper, silver, gold, copper sulfide, cobalt sulfide, etc., are more effective. A suitable amount of the material having a catalytic function is about 1 mg/m$^2$ to about 3 g/m$^2$, preferably 5 mg/m$^2$ to 1 g/m$^2$.

A reducing agent is oxidized faster by the cobalt (III) complex in the presence of the image-wise distributed material having a catalytic function, but it is oxidized at very slow speed in the areas where the material having a catalytic function is absent, and such forms images by itself by oxidation or the oxidation product thereof reacts with a color-forming agent to form images.

While conventional photographic elements employed in cameras contain a silver salt in an amount of about 3 to about 10 g/m$^2$ (calculated as silver) and photographic elements for photographic prints contain a silver salt in an amount of 1 to 4 g/m$^2$ (calculated as silver), the photographic elements of the invention contain a silver salt in an amount of not more than about 5 g/m$^2$, particularly not more than 3 g/m$^2$ (calculated as silver). Where the elements are multilayer elements, a single light-sensitive layer contains a silver salt in an amount of not more than about 2 g/m$^2$, particularly not less than 1 mg/m$^2$ to not more than 1 g/m$^2$.

A color forming agent used in the invention is a compound capable of forming a dye by reaction with an oxidized color developing agent. Examples of suitable color forming agents include couplers employed in conventional color light-sensitive elements such as open-chain ketomethylene type couplers, 5-pyrazolone type couplers, indazolone type couplers, phenol or naphthol type couplers; diffusible dye releasing (DDR) couplers capable of releasing diffusible dyes by reaction of the color developing agents as disclosed in British Patent No. 840,731, U.S. Pat. No. 3,227,550, Japanese Patent Application (OPI) No. 123,022/74 and Japanese Patent Application No. 57,040/75; and amidrazone compounds capable of releasing diffusible dyes by reaction of the oxidation products of the developing agents as disclosed in Japanese Patent Publication No. 39,165/73.

In a typical embodiment of the invention, couplers are incorporated into light-sensitive elements, and the amount of the coupler used is decided so that a sufficient color density is achieved. A suitable amount is usually an equimolar or larger amount of the coupler to the silver present in the photographic elements. Couplers can be suitably selected from well-known couplers.

Couplers, that is, compounds capable of forming dyes by reaction with the oxidized developing agents are incorporated into a light-sensitive photographic emulsion layer of color photographic light-sensitive elements in an amount of about 50 mg/m$^2$ to about 3 g/m$^2$, preferably 100 mg/m$^2$ to 2 g/m$^2$ in each photosensitive layer. Such couplers have chemical structures so that they do not diffuse to the other layers during the preparation of the photographic elements or during the processings.

Couplers which can be employed in the invention are set forth below.

Suitable yellow couplers include open chain ketomethylene type compounds as disclosed in U.S. Pat. Nos. 3,341,331, 2,875,057, 3,551,155, German Patent Application (OLS) No. 1,547,868, U.S. Pat. Nos. 3,265,506, 3,582,322, 3,725,072, German Patent Application (OLS) No. 2,162,899, U.S. Pat. Nos. 3,369,895, 3,408,194, German Patent Applications (OLS) No. 2,057,941, 2,213,461, 2,219,917, 2,261,361 and 2,263,875.

Suitable magenta couplers include not only 5-pyrazolone type compounds which are usually employed but also indazolone type compounds and cyanoacetyl compounds. Examples of suitable magenta couplers are disclosed in U.S. Pat. Nos. 2,439,098, 2,600,788, 3,062,653, 3,558,319, British Pat. No. 956,261, U.S. Pat. Nos. 3,582,322, 3,615,506, 3,519,429, 3,311,476, 3,419,391, German Patent Applications (OLS) No. 2,408,665, 2,424,467, 2,418,959, German Patent No. 1,810,464, Japanese Patent Publication No. 2,016/69, U.S. Pat. No. 2,983,608, etc.

Phenol or naphthol derivatives are usually employed as cyan couplers. Examples of suitable cyan couplers are disclosed in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, 3,583,971, German Patent Applications (OLS) No. 2,163,811, 2,414,006, and Japanese Patent Publication No. 28,836/70.

In addition, development inhibitor releasing type couplers (the so-called DIR couplers) and compounds capable of releasing compounds having a development inhibiting action can be employed in the invention. Examples of these couplers which are suitable are disclosed in U.S. Pat. Nos. 3,148,062, 3,227,554, 3,253,924, 3,617,291, 3,622,328, 3,705,201, British Patent No. 1,201,110, U.S. Pat. Nos. 3,297,445, 3,379,529, 3,639,417, etc.

Two or more of the above couplers can be incorporated into a single layer, or a single coupler can be incorporated into two or more layers.

Couplers incorporated in a unit layer of the invention are water-insoluble couplers which are mixed with a color coupler solvent, preferably having a suitable polarity. Typical examples of useful solvents are tri-o-cresyl phosphate, tricresyl phosphate, dioctylbutyl phosphate, dibutyl phthalate, diethyl laurylamide, 2,4-diallylphenol, and the liquid-dye stabilizers as disclosed in "Improved Photographic Dye Image Stabilizing Solvents" *Product Licensing Index*, Vol. 83, pages 26–29 (March, 1971). Photographic elements containing coupler solvents promote the absorption of color developing solutions when the photographic elements are introduced from a developing bath into an amplifying bath.

Advantageously, the photographic couplers used are selected so that they will provide a good neutral dye image. A preferred maximum absorption region for the cyan dyes formed by cyan couplers ranges from about 600 to about 720 nm, that for the magenta dyes formed by magenta couplers ranges from about 500 to about 580 nm, and that for the yellow dyes formed by yellow couplers ranges from about 400 to about 480 nm.

Suitable silver halide emulsions which can be used in the photographic element employed in the invention can be prepared by mixing a water-soluble silver salt (e.g., silver nitrate) with a water-soluble halide (e.g., potassium bromide) in the presence of a solution of a water-soluble high molecular weight compound (e.g., gelatin). Silver chloride, silver bromide and mixed silver halides (e.g., silver chlorobromide, silver iodobromide or silver chloroiodobromide) can be used as the silver halide for the emulsion.

The shape of the grains of these silver halides may be cubic, octahedral or a mixture thereof.

Further, two or more silver halide photographic emulsions which are separately prepared may be mixed. The crystal structure of silver halide grains may be uniform from the surface to the inside, or may be different between the surface and the inside, or may be the conversion type silver halide grains as disclosed in British Patent No. 635,841 and U.S. Pat. No. 3,622,318. Further, silver halide emulsions can be those in which latent images are formed on the surface of the grains or those in which latent images are formed in the interior of the grains. These photographic emulsions can be prepared using an ammoniacal method, a neutral method or an acidic method, e.g., as disclosed in C. E. K. Mees & T. H. James, *The Theory of the Photographic Process*, 3rd Ed., Macmillan Co., New York (1966) and P. Grafkides, *Chimie Photographique*, Paul Montel Co., Paris (1957).

The above-described silver halide emulsions can be chemically sensitized using conventional techniques. Suitable chemical sensitizers include gold compounds such as chloroaurates or gold trichloride as disclosed in U.S. Pat. Nos. 2,399,083, 2,540,085, 2,597,856 and 2,597,915; noble metal salts such as platinum, palladium, iridium, rhodium or ruthenium as disclosed in U.S. Pat. Nos. 2,448,060, 2,540,086, 2,566,245, 2,566,263 and 2,598,079; sulfur compounds capable of forming silver sulfides as disclosed in U.S. Pat. Nos. 1,574,944, 2,410,689, 3,189,458 and 3,501,313; stannous salts, amines and other reducing materials as disclosed in U.S. Pat. Nos. 2,487,850, 2,518,698, 2,521,925, 2,521,926, 2,694,637, 2,983,610 and 3,201,254.

Often various additives are added to the emulsion to obtain desired development properties, image characteristics and layer properties in photographic elements. Iodides such as alkali metal iodides, and organic compounds having a mercapto group can be used, but these compounds should not be added in large amounts.

Further, the photographic elements used in this invention can contain hardening agents, plasticizers, lubricating agents, surface agents, glossing agents and other conventional additives known in the art.

Suitable examples of hydrophilic colloids which can be used include gelatin, colloidal albumin, a cellulose derivative (e.g., carboxymethyl cellulose, hydroxyethyl cellulose, etc.), agar-agar, sodium alginate, saccharides such as starch derivatives and synthetic hydrophilic colloids such as polyvinyl alcohol, poly-N-vinylpyrrolidone, polyacrylic acid copolymers, polyacrylamide, the derivatives thereof or the partially hydrolyzed products thereof. If desired, a mixture of two or more compatible colloids can be used. The most usually used colloid of the colloids is gelatin, and a portion or all of the gelatin can be replaced by synthetic high molecular weight materials. Gelatin derivatives can also be employed for the gelatin.

The photographic emulsions can be spectrally sensitized or supersensitized with cyanine dyes such as cyanine, merocyanine or carbocyanine dye individually or as a combination thereof or in combination with styryl dyes. These spectral sensitization techniques are well known and are disclosed in U.S. Pat. Nos. 2,493,748, 2,519,001, 2,977,229, 3,480,434, 3,672,897, 3,703,377, 2,688,545, 2,912,329, 3,397,060, 3,615,635, 3,628,964, British Pat. Nos. 1,195,302, 1,242,588, 1,293,862, German Patent Applications (OLS) Nos. 2,030,326, 2,121,780, Japanese Patent Publication Nos. 4936/68, 14,030/69, 10,773/68, U.S. Pat. Nos. 3,511,664, 3,522,052, 3,527,641, 3,615,613, 3,615,632, 3,617,295, 3,635,721, 3,694,217, British Pat. Nos. 1,137,580 and 1,216,203. The selection of the compounds to be used is based upon the purposes and use of the light-sensitive elements, by wavelength region to be sensitized or the sensitivity desired.

The photographic elements employed in the invention comprise a support having coated thereon at least one silver halide emulsion layer, usually a red-sensitive silver halide emulsion layer, a green-sensitive silver halide emulsion layer and a blue-sensitive silver halide emulsion layer, or a red-sensitive silver halide emulsion layer containing a cyan color-forming coupler, a green-sensitive silver halide emulsion layer containing a magenta color-forming coupler and a blue-sensitive silver halide emulsion layer containing a yellow color-forming coupler. The photographic elements used in this invention may contain non-light-sensitive photographic layers (e.g., antihalation layers, intermediate layers for preventing color mixing, yellow filter layers, protective layers, receiving layers, etc.). The order of the photographic layers on the support is not particularly limited. For example, a red-sensitive layer, a green-sensitive layer and a blue-sensitive layer can be provided from the support in this order, a blue-sensitive layer, a red-sensitive layer and a green-sensitive layer can be provided in this order or a blue-sensitive layer, a green-sensitive layer and a red-sensitive layer can be provided in this order. A silver halide unit emulsion layer of the photographic elements employed in the invention can be composed of a plurality of layers as disclosed in U.S. Pat. No. 3,726,681, British Pat. Nos. 818,687, 923,045, U.S. Pat. No. 3,516,831, Japanese Patent Application Nos. 5,179/75 and 42,541/75, or can be composed of various layers.

Suitable photographic supports include cellulose nitrate films, cellulose acetate films, cellulose acetate butyrate films, cellulose acetate propionate films, polystyrene films, polyethylene terephthalate films, polycarbonate films, laminated films thereof, thin glass and papers, baryta papers, papers laminated or coated with $\alpha$-olefin polymers, particularly those of $\alpha$-olefins having 2 to 10 carbon atoms such as polyethylene, polypropylene or ethylene-butene copolymers, and synthetic resin films of which the surface is matted to improve the adhesion properties with other high molecular weight materials as disclosed in Japanese Patent Publication No. 19,068/72.

These supports can be transparent or opaque depending on the purpose of the light-sensitive elements. Further, the transparent supports may be colorless or colored by adding dyes or pigments to them. Colored supports have been used for X-ray photographic films, as disclosed in *J. SMPTE*, 67, 296 (1958).

Opaque supports include papers, films containing dyes or pigments (e.g., titanium oxide), syntehtic resin films of which the surface has been treated by the method as disclosed in Japanese Patent Publication No. 19,068/72, completely light-interrupted papers or synthetic resin films containing carbon black or pigments, etc. A subbing layer can be provided to improve the adhesion between the support and the photographic layer. The surface of supports can be treated using a pretreatment method such as corona discharge, U.V. exposure or a flame treatment to improve adhesion properties.

The photographic elements employed in the invention are composed of a support having coated thereon at least one dye image-providing unit layer. Multi-color photographic elements comprise a support having coated thereon at least two dye image-providing layers, each of which is sensitive to different regions of the spectrum. The unit layer contains a light-sensitive silver salt, spectrally sensitized to a specific spectral region, and is combined with photographic color couplers. The color-providing layers are effectively separated from each other by a layer (e.g., a barrier layer, a spacing layer, a layer containing a scavenger for oxidized developing agent, etc.) to prevent formation of color stain in the unit layer. Effective separation methods for the unit layers are known in the art, and have been employed in commercial color photographic elements to prevent color stain. Also, light-sensitive elements having a development stain-protecting layer, as disclosed in U.S. Pat. No. 3,737,317, German Patent Applications (OLS) Nos. 2,431,223 and 2,448,232, can be employed in the invention.

The photographic layers employed in the invention can be coated using various methods, for example, a dip coating method, an air knife coating method, a curtain coating method or a hopper type extrusion coating method as disclosed in U.S. Pat. No. 2,681,294.

If desired, two or more layers can be simultaneously coated using a method such as is disclosed in U.S. Pat. Nos. 2,761,791 and 3,508,947, and British Patent No. 837,095. The photographic elements may be prepared for the color image transfer method as disclosed in U.S. Pat. Nos. 3,087,817, 3,185,567, 2,983,606, 3,253,915, 3,227,550, 3,227,551, 3,227,552, 3,145,633, 3,415,645 and 3,415,646, or for the absorption transfer method as disclosed in U.S. Pat. No. 2,882,156.

Typical embodiments of the process of the invention comprise subjecting an image-wise exposed photographic element to a development-amplifying by using a solution containing a cobalt (III) complex, a developing agent and an organic phosphonic acid of the invention, and then bleaching and fixing or bleach-fixing, followed by washing and drying, whereby color images are obtained. Where light-sensitive elements containing only a very small amount of a catalyst (e.g., silver) are employed or for some purposes, bleaching can be omitted.

In another embodiment of the invention, the image-wise exposed light-sensitive element is developed, amplified with an amplifying solution containing a cobalt (III) complex and an organic phosphonic acid of the invention, bleached and fixed or bleach-fixed, followed by washing and drying to form color images. After the amplifying step, a rinsing step, a washing step and a bleaching step can be employed.

In still another embodiment of the invention, development, amplifying and bleach-fixing can be simultaneously carried out using a solution containing a cobalt (III) complex, a developing agent, a silver halide solvent (e.g., sodium thiosulfate or ammonium thiosulfate) and an organic phosphonic acid of the invention, followed by washing and drying to form color images.

A preferred embodiment of the invention is to development-amplify a photographic element comprising a support having coated thereon at least one photographic layer containing an image-wise distributed catalytic material with a solution containing a cobalt (III) complex and an organic phosphonic acid.

Subtraction type dye images can be formed using color negative methods as disclosed in *Journal of the Society of Motion Picture and Television Engineers*, Vol. 61, pages 667–701 (1953), or employing color reversal methods using direct positive emulsions or negative emulsions which are image-wise exposed, developed with a black-and-white developing solution to form negative silver images, re-exposed (or subjected to an appropriate fogging) and then developed. In this case, a bleaching step is carried out after the black-and-white development so that the silver formed by the development does not act as a catalyst, and an amplifying step is carried out after color development.

The processing temperature used in the invention is not particularly limited, and usually is about 10° C. to about 80° C., preferably 20° C. to 70° C.

The process of the invention provides advantages over conventional methods with some being set forth below.

Firstly, the stability of the processing solution is increased because the reaction of the cobalt (III) complex and the reducing agent is inhibited even if they are present together.

Secondly, fog and stain are markedly reduced and so better images can be obtained.

Thirdly, the image quality is better because the color density is higher and color mixing is less, and the image quality is maintained even if the processings are carried out for a long period of time.

The invention will be explained more specifically by reference to the following examples, but the invention should not be construed as being limited to these embodiments. Unless otherwise indicated herein, all parts, percents, ratios and the like are by weight.

EXAMPLE 1

A photographic element having the following elements 1 to 7 was prepared.

(1) A paper support laminated with polyethylene, (2) A blue-sensitive silver chlorobromide emulsion layer containing 20 mol% of silver chloride, 150 mg/m$^2$ of silver, 1,500 mg/m$^2$ of gelatin and 600 mg/m$^2$ of a yellow coupler (α-pivaloyl-α-(2,4-dioxo-5,5-dimethyloxazolidin-3-yl)-2-chloro-5-[α-(2,4-di-tert-amylphenoxy)butanamido]-acetanilide) dispersed in 300 mg/m$^2$ of dioctylbutyl phosphate, (3) A layer containing 1,000 mg/m$^2$ of gelatin, (4) A green-sensitive silver chlorobromide emulsion layer containing 70 mol% of silver chloride, 100 mg/m$^2$ of silver, 800 mg/m$^2$ of gelatin and 350 mg/m$^2$ of a magenta coupler (1-(2,4,6-trichlorophenyl)-3-[(2-chloro-5-tetradecanamido)anilino]-2-pyrazolin-5-one) dispersed in 170 mg/m$^2$ of tricresyl phosphate, (5) A layer containing 1,000 mg/m$^2$ of gelatin, 50 mg/m$^2$ of an ultraviolet light-absorbing agent and 50 mg/m$^2$ of dioctyl hydroquinone, (6) A red-sensitive silver chlorobromide emulsion layer containing 70 mol% of silver chloride, 100 mg/m$^2$ of silver, 700 mg/m$^2$ of gelatin and 300 mg/m$^2$ of a cyan coupler (2-[α-(2,4-di-tert-amylphenoxy)-butanamido]-4,6-dichloro-5-methylphenol) dispersed in 150 mg of n-butylphthalate, and (7) A layer containing 1,000 mg/m$^2$ of gelatin.

The photographic element was exposed to a sensitometer (color temperature of 2,854° K., 500 CMS) for 1 second, and then processed as follows:

| | | |
|---|---|---|
| Development-Amplifying | 40° C. | 4 min |
| Bleach-Fixing | " | 1 min 30 sec |

The processing solutions employed had the following compositions.

Development-Amplifying Solution I

| | | |
|---|---|---|
| Benzyl Alcohol | 10 | ml |
| Potassium Sulfite | 2 | g |
| Sodium Bromide | 0.5 | g |
| Sodium Chloride | 0.5 | g |
| Hydroxylamine Sulfate | 2 | g |
| N-Ethyl-N-methoxyethyl-3-methyl-p-phenylenediamine Di-p-toluenesulfonate | 5 | g |
| Sodium Carbonate | 30 | g |
| Hexaamine Cobalt (III) Chloride [$Co(NH_3)_6Cl_3$] | 1.6 | g |
| 1,3-Diaminopropanoltetraacetic Acid | 5 | g |
| Water to make | 1 | l |
| | (pH 10.0) | |

Development Amplifying Solution II 6 g of 1-Hydroxyethane-1,1-diphosphonic acid was added to Development-Amplifying Solution I and then the pH thereof was adjusted to 10.0 using sodium hydroxide.

| Bleach-Fixing Solution | | |
|---|---|---|
| 1,3-Diaminopropanoltetraacetic Acid | 3 | g |
| Glacial Acetic Acid | 20 | ml |
| Ammonium Thiosulfate (70% aq. soln.) | 130 | ml |
| Sodium Sulfite | 15 | g |
| Hexaamine Cobalt (III) Chloride [$Co(NH_3)_6Cl_3$] | 3 | g |
| Water to make | 1 | l |
| | (pH 4.5) | |

Then, Development-Amplifying Solutions I and II were allowed to stand for 2 days at 40° C., a separate set of photographic samples was exposed, and the same processing as described above was carried out using the development-amplifying solutions thus stored. The photographic properties obtained are shown in Table 1 below.

TABLE 1

| Amplifying | Fresh solution | | | | | | Stored Solution | | | | | |
|---|---|---|---|---|---|---|---|---|---|---|---|---|
| | Fog | | | Maximum Density | | | Fog | | | Maximum Density | | |
| Solution | R | G | B | R | G | B | R | G | B | R | G | B |
| I* | 0.12 | 0.12 | 0.20 | 2.56 | 2.40 | 2.10 | 0.62 | 0.33 | 0.60 | 2.58 | 2.44 | 2.23 |
| II** | 0.12 | 0.12 | 0.19 | 2.55 | 2.37 | 2.12 | 0.21 | 0.18 | 0.28 | 2.57 | 2.39 | 2.15 |

*Invention

**For comparison

As shown in Table 1, Development-Amplifying Solution II causes less fog in the fresh solution and in the solution stored for a period of time.

EXAMPLE 2

The same photographic element as described in Example 1 was exposed using the same sensitometer and conditions as in Example 1, and then was processed as follows:

| Processing Step | | |
|---|---|---|
| Color Development | 40° C. | 1 min |
| Amplifying | " | 1 min 30 sec |
| Bleach-Fixing | " | 1 min |
| Washing | 26° C. | 1 min 30 sec |
| Drying | | |

The processing solutions employed had the following compositions.

| Color Developing Solution | | |
|---|---|---|
| Benzyl Alcohol | 15 | ml |
| Potassium Carbonate | 30 | g |
| Potassium Bromide | 0.4 | g |
| Hydroxylamine Sulfate | 2 | g |
| Potassium Sulfite | 4 | g |
| Diaminopropanoltetraacetic Acid | 3 | g |
| N-Ethyl-N-methoxyethyl-3-methyl-p-phenylenediamine p-Toluenesulfonate | 7.5 | g |
| Water to make | 1 | l |
| | (pH 10.1) | |

Amplifying Solution I

| | | |
|---|---|---|
| Hexaamine Cobalt (III) Chloride $[Co(NH_3)_6Cl_3]$ | 10 | g |
| Potassium Bromide | 2 | g |
| Benzyl Alcohol | 15 | ml |
| Potassium Carbonate | 7.5 | g |
| 1,3-Diaminopropanoltetraacetic Acid | 10 | g |
| Water to make | 1 | l |
| | (pH 10.1) | |

Amplifying Solution II 5 g of 1-hydroxyethane-1,1-diphosphonic acid was added to Amplifying Solution I and then the pH thereof was adjusted to 10.1 with sodium hydroxide.

Amplifying Solution III 5 g of ethylenediamine-N,N,N',N'-tetramethylene phosphonic acid was added to Amplifying Solution I and then the pH thereof was adjusted to 10.1 with sodium hydroxide.

Bleach-Fixing Solution

Same as described in Example 1.

10% of the color developing solution was added to the amplifying solution and the mixture was allowed to stand for 2 days at 40° C., a separate set of photographic samples was exposed, and the same processing as described above was carried out using the development-amplifying solutions thus stored. The thus-obtained results are shown in Table 2 below.

TABLE 2

| Amplifying Solution | Fresh | | | | | | Stored | | | | | |
|---|---|---|---|---|---|---|---|---|---|---|---|---|
| | Fog | | | Maximum Density | | | Fog | | | Maximum Density | | |
| | R | G | B | R | G | B | R | G | B | R | G | B |
| I** | 0.12 | 0.12 | 0.16 | 2.52 | 2.38 | 2.10 | 0.44 | 0.26 | 0.46 | 2.54 | 2.43 | 2.12 |
| II* | 0.12 | 0.12 | 0.16 | 2.51 | 2.36 | 2.08 | 0.21 | 0.18 | 0.22 | 2.52 | 2.39 | 2.09 |
| III* | 0.12 | 0.12 | 0.16 | 2.49 | 2.36 | 2.07 | 0.20 | 0.18 | 0.24 | 2.50 | 2.37 | 2.09 |

*Invention
**For comparison

Where processing is continuously carried out, a large amount of developing solution is introduced into the amplifying solution. This Example 2 was carried out to check this problem. Amplifying Solutions II and III, containing color developer solution and stored for a period of time provided less fog.

While the invention has been described in detail and with reference to specific embodiments thereof, it will be apparent to one skilled in the art that various changes and modifications can be made therein without departing from the spirit and scope thereof.

What is claimed is:

1. A method for forming color dye images which comprises image-amplifying an image-wise exposed photographic element, said photographic element comprising a support having thereon at least one silver halide photographic layer containing an image-wise distributed material having a catalytic action and with said photographic element containing a color dye-forming material, by processing the element with a solution containing (1) at least one cobalt (III) complex having a coordination number of 6, which comprises a cobalt atom coordinated with a ligand selected from the group consisting of ethylenediamine, diethylenetriamine, triethylenetetramine, ammonia, nitrate, nitrite, azide, chloride, thiocyanate, isothiocyanate, water, carbonate or ethlenediamine tetraacetic acid (2) 1 g to 20 g per liter of solution of at least one organic phosphonic acid compound and (3) said solution having a pH of 8 to 11, in the presence of a color developing agent selected from the group consisting of a p-phenylenediamine color developing agent and an onium salt p-aminophenol color developing agent, said color developing agent being in the amplifying solution or in a solution applied prior to the amplifying solution.

2. The method of claim 1, wherein said cobalt (III) complex is a complex containing at least five ammine ligands.

3. The method of claim 1, wherein said organic phosphonic acid compound is a compound represented by the general formula (I):

$$R_1N(CH_2PO_3M_2)_2 \quad (I)$$

wherein M represents a hydrogen atom, an alkali metal ion, an ammonium ion, a pyridinum ion, a triethanolammonium ion or a triethylammonium ion; and $R_1$ represents an alkyl group having 1 to 4 carbon atoms, an aryl group, an aralkyl group, an alicyclic group, a heterocyclic group, or a heterocyclic alkyl group, in which $R_1$ can be substituted with one or more of a hydroxy group, an alkoxy group, a halogen atom, $—PO_3M_2$, $—CH_2PO_3M_2$ or $—N(CH_2PO_3M_2)_2$, wherein M has the same meaning as described above; or by the general formula (II):

$$R_2R_3C(PO_3M_2)_2 \quad (II)$$

wherein $R_2$ represents a hydrogen atom or an alkyl group, an aralkyl group, an acyclic group, a heterocyclic group, or a heterocyclic alkyl group defined above for $R_1$, $—CHR_4—PO_3M_2$ wherein $R_4$ represents a hydrogen atom, a hydroxy group or an unsubstituted alkyl group or $—PO_3M_2$, wherein M is as defined above; and $R_3$ represents a hydrogen atom, a hydroxyl group, an alkyl group which may be substituted as described for the alkyl group for $R_1$ or $—PO_3M_2$, wherein M has the same meaning as described above.

4. The method of claim 1, wherein said organic phosphonic acid compound is ethylenediamine-N,N,N',N'-tetramethylene phosphonic acid, nitrilo-N,N,N-trimethylene phosphonic acid, 1,3-diaminopropanol-N,N,N',N'-tetramethylene phosphonic acid, 1,3-propanediamine-N,N,N',N'-tetramethylene phosphonic acid, 1,6-hexanediamine-N,N,N',N'-tetramethylene phosphonic acid, 1-hydroxyethane-1,1-diphosphonic acid, 2-hydroxyethane-1,1-diphosphonic acid, 1-hydroxyethane-1,1,2-triphosphonic acid or ethane-1,1-diphosphonic acid.

5. The method of claim 1, wherein said cobalt (III) complex is present in said solution in an amount of about 0.1 g to about 100 g per liter of said solution.

6. The method of claim 1 wherein said developing agent is a p-phenylenediamine color developing agent.

7. The method of claim 1, wherein said image-amplifying is followed by bleaching and fixing or bleach-fixing.

* * * * *